US007181873B1

(12) United States Patent
Hackethal

(10) Patent No.: US 7,181,873 B1
(45) Date of Patent: Feb. 27, 2007

(54) SPOT LIGHT IRON

(76) Inventor: Dorothy Hackethal, 6205 Orange Ave., Rialto, CA (US) 92377

( * ) Notice: Subject to any disclaimer, the term of this patent is extended or adjusted under 35 U.S.C. 154(b) by 0 days.

(21) Appl. No.: 11/112,902

(22) Filed: Apr. 24, 2005

Related U.S. Application Data

(60) Provisional application No. 60/576,682, filed on Jun. 4, 2004.

(51) Int. Cl.
*D06F 75/22* (2006.01)
*F21V 33/00* (2006.01)
*D06F 75/30* (2006.01)

(52) U.S. Cl. ..... 38/75; 38/88; 362/117

(58) Field of Classification Search ..... 38/74, 38/75, 77.5, 77.7, 77.8, 77.83, 88, 90, 93, 38/94; D32/68–72; 219/248, 250, 254, 219/256; 362/89, 253, 117, 603
See application file for complete search history.

(56) References Cited

U.S. PATENT DOCUMENTS 1,684,742 A * 9/1928 Picklesimer ..... 362/117
2,209,086 A * 7/1940 Johnson ..... 362/117
2,440,041 A * 4/1948 Clark ..... 219/249
2,496,746 A * 2/1950 Opperman ..... 219/252
2,607,139 A * 8/1952 Snyder et al. ..... 38/82
2,624,832 A 1/1953 Moyer
2,682,604 A * 6/1954 Gerber ..... 362/91
3,599,357 A * 8/1971 Gronwick et al. ..... 38/77.5
4,347,428 A * 8/1982 Conrad et al. ..... 219/251
4,743,736 A * 5/1988 Albinger et al. ..... 219/250
5,250,139 A 10/1993 Hall
5,844,203 A 12/1998 Chasen
5,901,481 A * 5/1999 Simmons et al. ..... 38/93
6,665,963 B1 * 12/2003 Wright ..... 38/94

* cited by examiner

*Primary Examiner*—Ismael Izaguirre

(57) ABSTRACT

An iron for use while ironing clothes and other fabrics. The iron is a standard iron with a light attached to the front end of the iron, with the light shining downward and forward while the iron is a downward position and is in use.

4 Claims, 3 Drawing Sheets

SPOT LIGHT IRON

I. CROSS-REFERENCE TO RELATED APPLICATIONS

This application claims the benefit of U.S. Provisional Application No. 60/576,682, filed Jun. 4, 2004.

II. BACKGROUND OF THE INVENTION

The present invention concerns that of a new and improved iron for use while ironing clothes and other fabrics.

III. DESCRIPTION OF THE PRIOR ART

U.S. Pat. No. 5,844,203, issued to Chasen, discloses an electrical iron having switch for activating an incorporated light.

U.S. Pat. No. 5,250,139, issued to Hall, discloses a lighted iron having a first and second light source incorporated.

U.S. Pat. No. 2,624,832, issued to Moyer, discloses an electric iron having a chamber containing a light that is suited to emit forward rays to illuminate the material to be ironed.

IV. SUMMARY OF THE INVENTION

The present invention concerns that of a new and improved iron for use while ironing clothes and other fabrics. The iron is a standard iron with a light attached to the front end of the iron, with the light shining downward and forward while the iron is a downward position and is in use.

There has thus been outlined, rather broadly, the more important features of an iron that the detailed description thereof that follows may be better understood and in order that the present contribution to the art may be better appreciated. There are, of course, additional features of the iron that will be described hereinafter and which will form the subject matter of the claims appended hereto.

In this respect, before explaining at least one embodiment of the iron in detail, it is to be understood that the iron is not limited in its application to the details of construction and to the arrangements of the components set forth in the following description or illustrated in the drawings. The iron is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present iron. It is important, therefore, that the claims be regarded as including such equivalent constructions insofar as they do not depart from the spirit and scope of the present invention.

It is therefore an object of the present invention to provide an iron which has all of the advantages of the prior art and none of the disadvantages.

It is another object of the present invention to provide an iron which may be easily and efficiently manufactured and marketed.

It is another object of the present invention to provide an iron which is of durable and reliable construction.

It is yet another object of the present invention to provide an iron which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
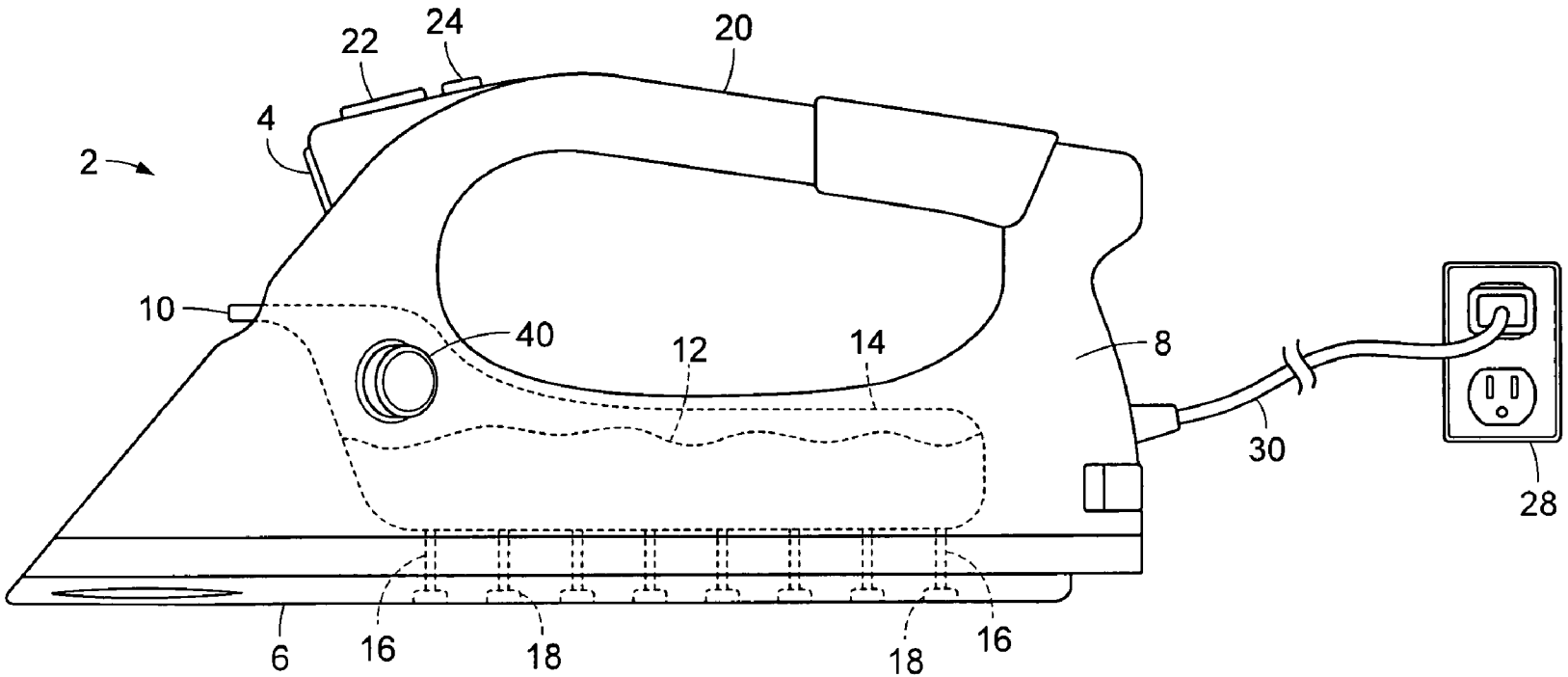
FIG. 1 shows a side view of the iron.
Figure 2:
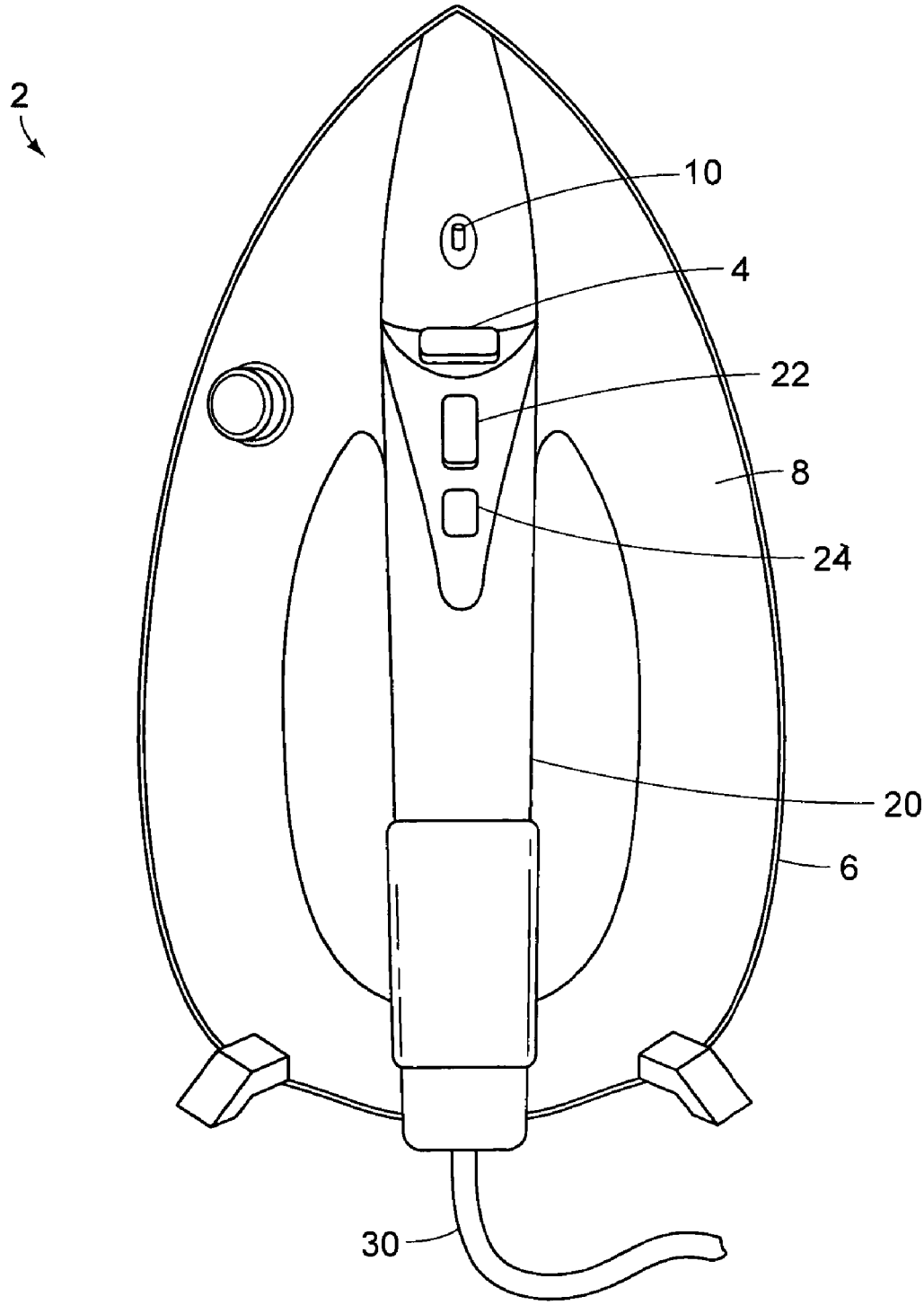
FIG. 2 shows a top view of the iron.
Figure 3:
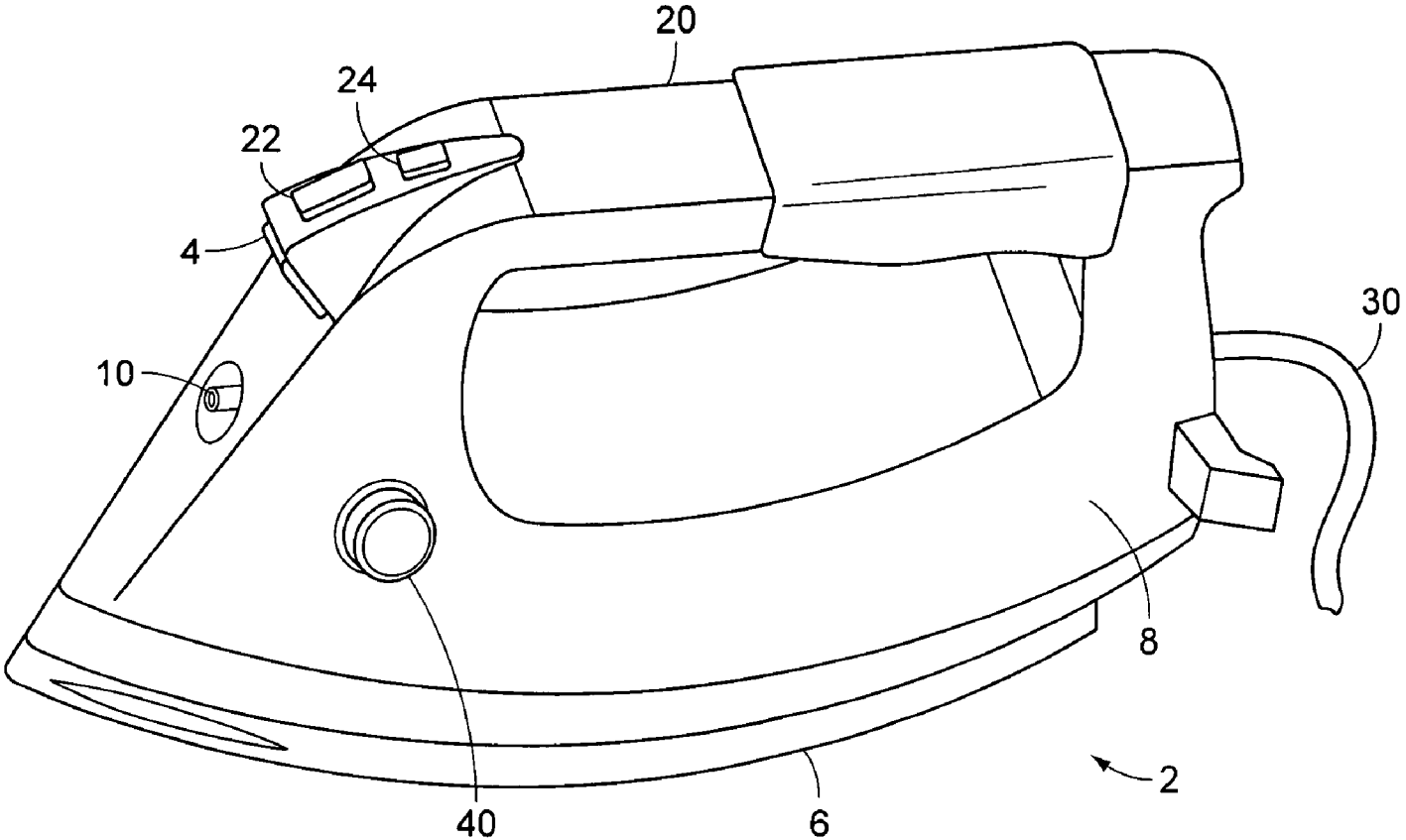
FIG. 3 shows a perspective view of the iron.

FIG. 1 shows a side view of the iron 2, FIG. 2 shows a top view of the iron 2, and FIG. 3 shows a perspective view of the iron 2. Iron 2 is designed to be like a typical iron, except that has an added light 4 that shines when the iron is in use.

Iron 2 has two ends, a top end and a bottom end. The iron also has a metal face plate 6 that has two surfaces, a bottom surface and a top surface. The body 8 of the iron is attached to the top surface of the face plate 6.

The top end of the iron 2 has a hole 10 into which a volume of water 12 can be placed. The water 12 then enters into an internal storage tank 14 that is located within the body of the iron 2. The storage tank is connected by a plurality of tunnels 16 to a plurality of holes 18 that are located on the face plate 6.

A handle 20 is attached to the body 8 of the iron 2, with the handle 20 having two ends, a front end and a rear end. Attached to the handle 20 near the front end of the handle 20 is an on/off switch 22, a steam button 24, and a light 4. The on/off switch 22 is a two-position switch that has an "on" position and an "off" position, and acts as a circuit between the power means 28 and the face plate 6 of the iron 2. Power means 28 is preferably standard household current, which is provided through an electrical cord 30. Power means 28 is connected to face plate 6, allowing face plate 6 to become extremely hot as long as the on/off switch 22 is turned to the "on" position.

Steam button 24, when depressed, causes a small amount of water 12 within the tank 14 to be ejected through the holes 18 via the tunnels 16. Because the face plate 6 is extremely hot after the on/off switch 22 has been turned to an "on" position for at least a few minutes, this amount of water 12 immediately turns to steam and helps to iron out wrinkles within clothes or fabric that is being treated.

Light 4 is attached to the front end of the handle 20 and actually overhangs the front end of the handle 20. As can be seen in FIG. 1, the light 4 shines both forward and downward when the iron is in a "down," or reclined, position. The light 4 is only when the on/off switch 22 is actually put in the "on" position, thereby to conserve light.

Dial 40 is attached to the side of the body 8 and is used to control how much the metal face plate 6 is actually heated up.

In use, the light 4 can help a great deal with an individual is using the iron 2. Small wrinkles and/or imperfections in clothing or fabric being ironed can be seen more easily, allowing an individual to treat the clothing or fabric in a more efficient and effective manner.

What I claim as my invention is:

1. An iron having two ends, a top end and a bottom end, the iron comprising:

a face plate having a bottom surface, a top surface, and a front end, a body having a front end, attached to the top surface of the face plate, an internal storage tank located within the iron, a volume of water located within the internal storage tank, a hole located at the top end of the iron, the hole connected to the internal storage tank, a plurality of holes located on the face plate, a plurality of tunnels located within the iron, the plurality of tunnels connecting the plurality of holes located on the face plate to the internal storage tank, a handle attached to the body of the iron, the handle having a front end and a rear end, power means for providing power to the face plate, the power means being connected to the face plate, a two-position switch connected to the handle, the two-position switch having two positions comprising an "on" position and an "off" position, wherein the switch acts as a circuit in between the power means and the face plate, and a light attached to the front end of the handle, the light mounted outside the handle on a top surface of the handle, the light angled below horizontal to shine downward and forward when the iron is in a horizontal, ironing position, wherein the light is on only when the two-position switch is in the "on" position, and wherein the front end of the face plate, the front end of the body, and the front end of the handle form a direct line from the light to the front end of the face plate such that shines directly in front of the iron along the direct line.

2. An iron according to claim 1 wherein the iron further comprises a steam button, the steam button attached to the handle, wherein depressing the steam button causes a small amount of the volume of water located within the internal tank to be ejected through the plurality of holes through the plurality of tunnels, further wherein the heat from the face plate causes the ejected water to become steam.

3. An iron according to claim 1 wherein the iron further comprises a dial, the dial located on the body of the iron, the dial being used to control the heat level of the face plate.

4. An iron according to claim 1 wherein the power means for providing power to the face plate further comprises standard household current.

* * * * *